US008137250B1

(12) United States Patent
Caban

(10) Patent No.: US 8,137,250 B1
(45) Date of Patent: Mar. 20, 2012

(54) ABDOMINAL EXERCISING APPARATUS

(76) Inventor: Andrew Caban, Ozone Park, NY (US)

( * ) Notice: Subject to any disclaimer, the term of this patent is extended or adjusted under 35 U.S.C. 154(b) by 75 days.

(21) Appl. No.: 12/369,300

(22) Filed: Feb. 11, 2009

(51) Int. Cl.
*A63B 21/00* (2006.01)
*A63B 71/00* (2006.01)

(52) U.S. Cl. ..... 482/140; 482/52; 482/131; 482/142

(58) Field of Classification Search ..... 482/19, 482/51, 52, 70, 92, 96, 131, 140
See application file for complete search history.

(56) References Cited

U.S. PATENT DOCUMENTS

| | | | | | |
|---|---|---|---|---|---|
| 3,589,720 | A * | 6/1971 | Agamian | 482/114 |
| 3,966,200 | A * | 6/1976 | Kirk | 482/23 |
| 4,159,111 | A | 6/1979 | Lowth | |
| 4,506,884 | A * | 3/1985 | Hankin | 482/131 |
| 4,645,201 | A * | 2/1987 | Evans | 482/70 |
| 4,679,786 | A * | 7/1987 | Rodgers | 482/70 |
| 4,684,121 | A * | 8/1987 | Nestegard | 482/70 |
| 4,781,372 | A * | 11/1988 | McCormack | 482/70 |
| 4,948,121 | A * | 8/1990 | Haaheim et al. | 482/70 |
| 5,044,355 | A * | 9/1991 | Reopelle | 601/29 |
| 5,110,118 | A | 5/1992 | Winey | |
| 5,224,909 | A * | 7/1993 | Hamilton | 482/70 |
| 5,503,609 | A * | 4/1996 | Bull | 482/70 |
| 5,518,483 | A * | 5/1996 | Oswald | 482/131 |
| 5,518,484 | A * | 5/1996 | Bruckenstein | 482/131 |
| 5,921,901 | A * | 7/1999 | Palacios | 482/132 |
| 5,989,163 | A * | 11/1999 | Rodgers, Jr. | 482/70 |
| D425,585 | S | 5/2000 | Wu | |
| 6,071,217 | A * | 6/2000 | Barnett | 482/121 |
| 6,196,954 | B1 * | 3/2001 | Chen | 482/131 |
| D444,517 | S | 7/2001 | Jonz | |
| 6,440,045 | B1 * | 8/2002 | Gaston | 482/140 |
| 6,500,099 | B1 | 12/2002 | Eschenbach | |
| 6,514,180 | B1 * | 2/2003 | Rawls | 482/70 |
| 6,595,904 | B1 | 7/2003 | Staffa | |
| 6,626,807 | B1 * | 9/2003 | Richmond | 482/123 |
| 7,004,894 | B1 * | 2/2006 | Trotter | 482/140 |
| 7,104,937 | B2 | 9/2006 | Arbuckle et al. | |
| 7,232,404 | B2 * | 6/2007 | Nelson | 482/140 |
| 7,270,628 | B2 * | 9/2007 | Campanaro et al. | 482/95 |
| 7,294,100 | B2 * | 11/2007 | Bull | 482/51 |
| 7,662,076 | B1 * | 2/2010 | Ho | 482/130 |
| 2001/0012811 | A1 * | 8/2001 | Gordon | 482/70 |
| 2004/0043876 | A1 * | 3/2004 | Craciunescu | 482/114 |
| 2004/0053752 | A1 * | 3/2004 | Yang | 482/70 |

(Continued)

FOREIGN PATENT DOCUMENTS

GB 2130900 A * 6/1984

*Primary Examiner* — Loan Thanh
*Assistant Examiner* — Sandhara Ganesan

(57) ABSTRACT

An abdominal exercising apparatus includes a frame with a first lateral member, a second lateral member, a first end member and a second end member attached together in a rectangular configuration. A pair of slides is provided. Each of the first and second lateral members has one of the slides attached thereto. The slides are slidable toward or away from the second end members and are engageable with a person's foot. A connecting assembly is coupled to each of the slides. The connecting assembly couples together the slides to cause a first one of the slides to move away from the second end member when a second one of the slides is moved toward the second end member. A person's feet are positionable on the slides while the person faces the upper surface of the frame. The person moves the slides back and forth to exercise the person's abdominal muscles.

9 Claims, 7 Drawing Sheets

U.S. PATENT DOCUMENTS

2004/0077468 A1* 4/2004 Myles et al. ..... 482/140
2004/0167000 A1* 8/2004 Schwarz ..... 482/123
2008/0070766 A1* 3/2008 Brown et al. ..... 482/140
2008/0200317 A1* 8/2008 Campanaro et al. ..... 482/140
2009/0018000 A1* 1/2009 Brown et al. ..... 482/140
2009/0098983 A1* 4/2009 Hoffman ..... 482/70
2009/0098988 A1* 4/2009 Kennedy ..... 482/140
2009/0105050 A1* 4/2009 Mayo ..... 482/70
2009/0298655 A1* 12/2009 Lacher ..... 482/134

* cited by examiner

ABDOMINAL EXERCISING APPARATUS

BACKGROUND OF THE INVENTION

Field of the Invention

The present invention relates to exercising devices and more particularly pertains to a new exercising device for exercising a person's abdominal muscles while also providing an aerobic workout.

SUMMARY OF THE INVENTION

The present invention meets the needs presented above by generally comprising a frame that includes a first lateral member, a second lateral member, a first end member and a second end member attached together in a rectangular configuration. The first and second lateral members are orientated parallel to each other and perpendicular to the end members. The frame has an upper surface and a lower surface. A plurality of legs is attached to and extends downwardly from the frame. A pair of slides is provided. Each of the first and second lateral members has one of the slides attached thereto and each is positioned on the upper surface of the frame. The slides are slidable toward or away from the second end members and are engageable with a person's foot. A connecting assembly is coupled to each of the slides. The connecting assembly couples together the slides to cause a first one of the slides to move away from the second end member when a second one of the slides is moved toward the second end member. A person's feet are positionable on the slides while the person faces the upper surface of the frame. The person moves the slides back and forth to exercise the person's abdominal muscles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
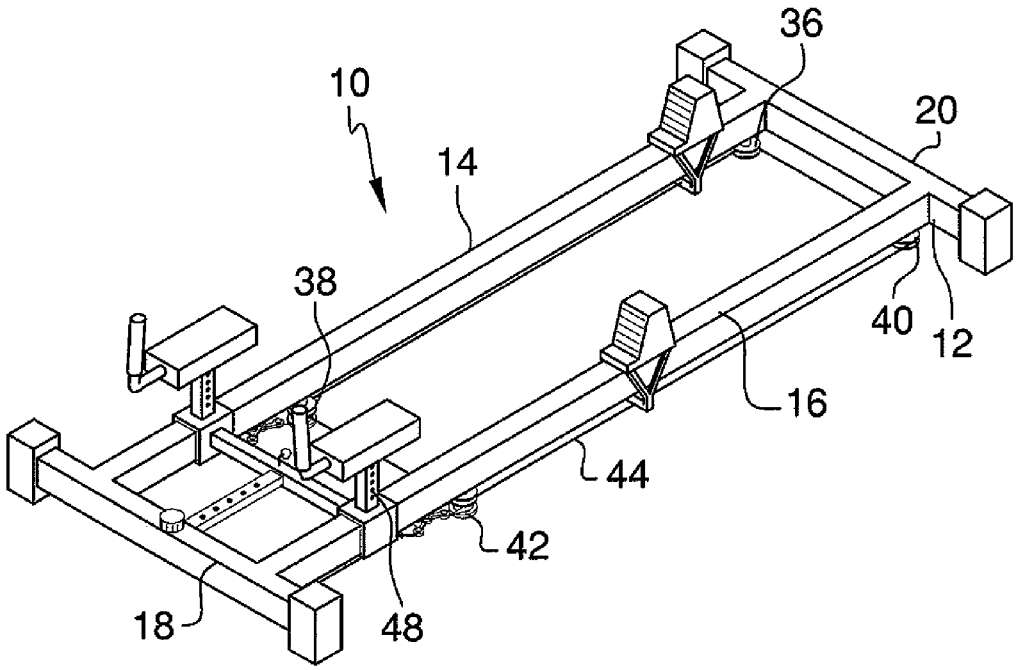
FIG. 1 is a top perspective view of a abdominal exercising apparatus according to the present invention.
Figure 2:
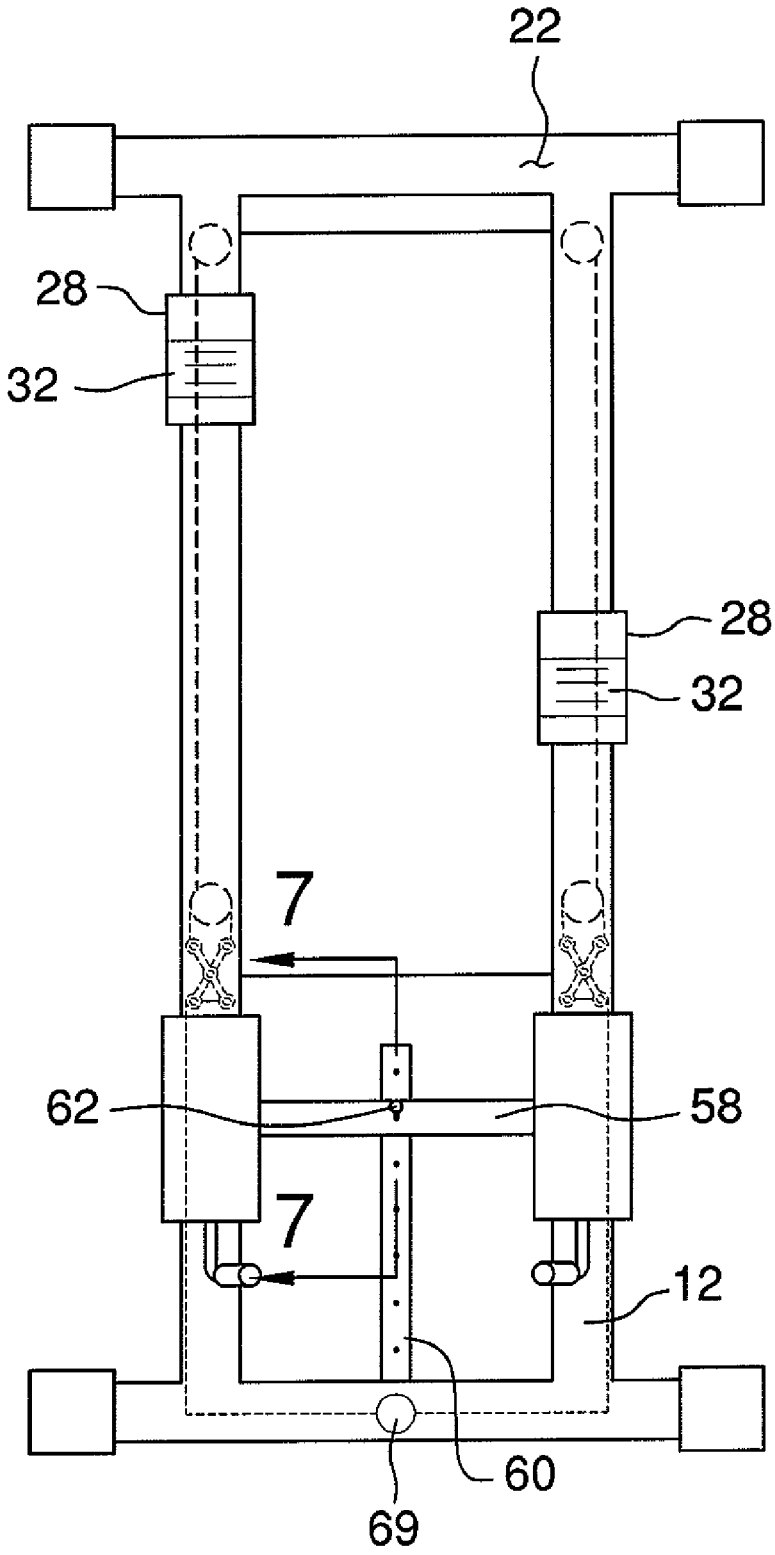
FIG. 2 is a top view of the present invention.
Figure 3:
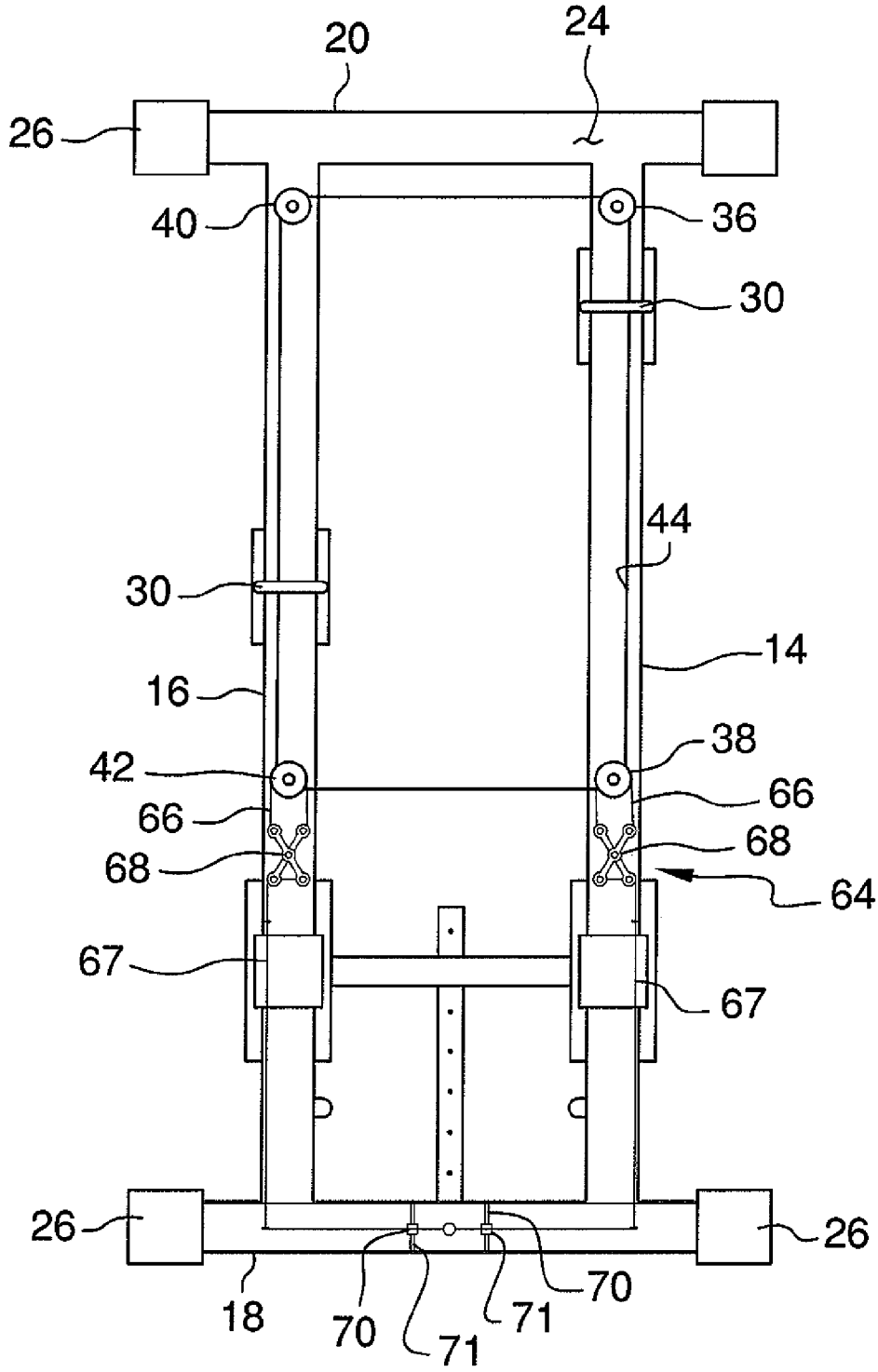
FIG. 3 is a bottom view of the present invention.
Figure 4:
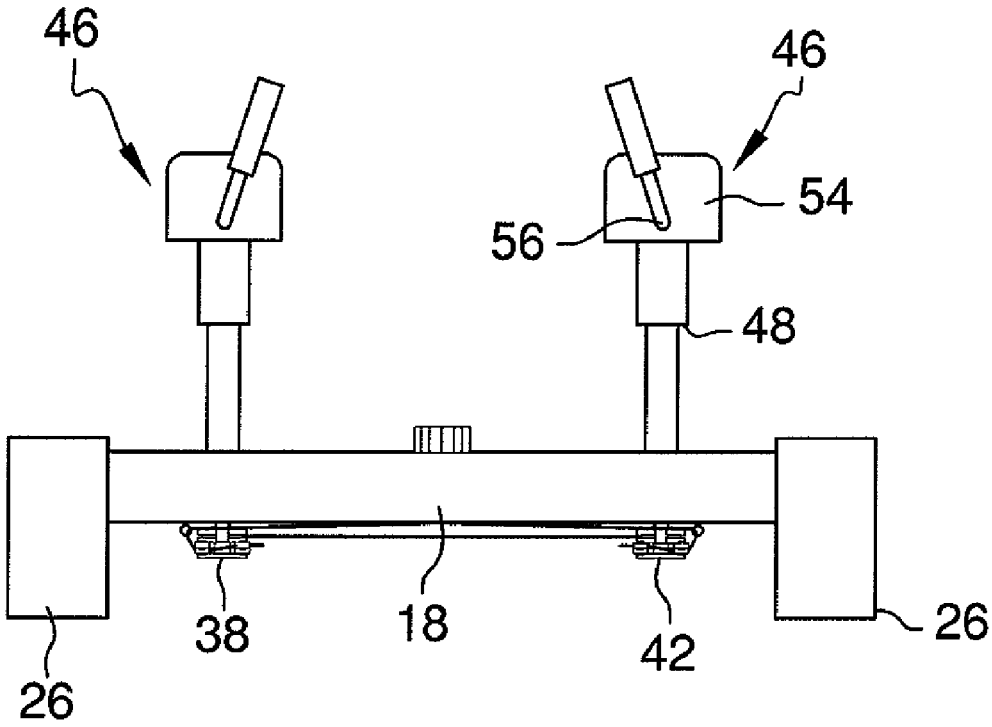
FIG. 4 is a front view of the present invention.
Figure 5:
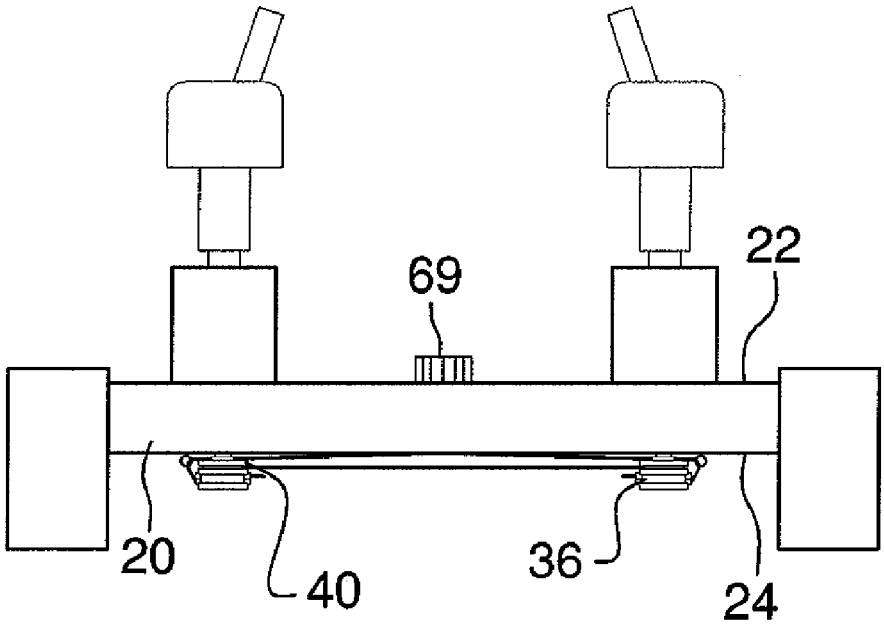
FIG. 5 is a rear view of the present invention.
Figure 6:
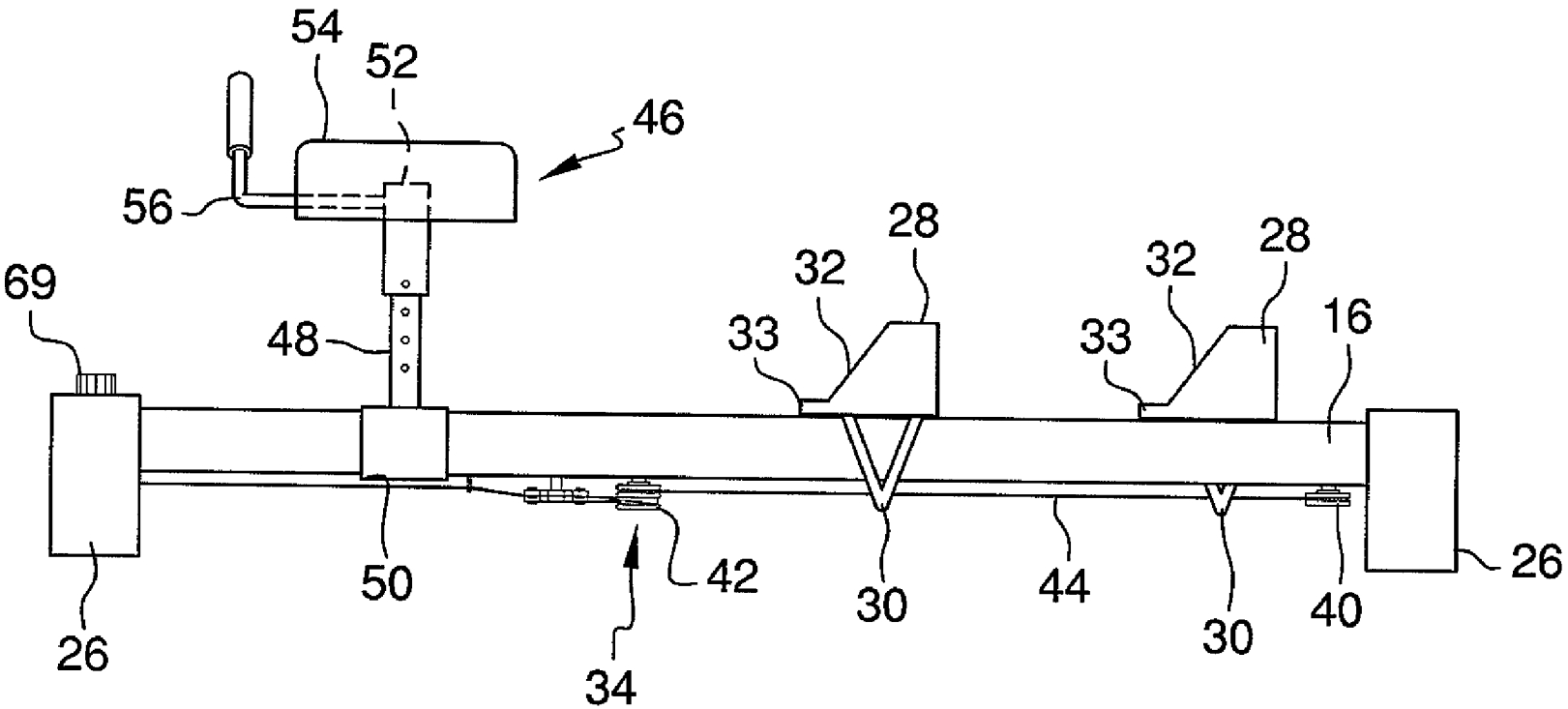
FIG. 6 is a side view of the present invention.
Figure 7:
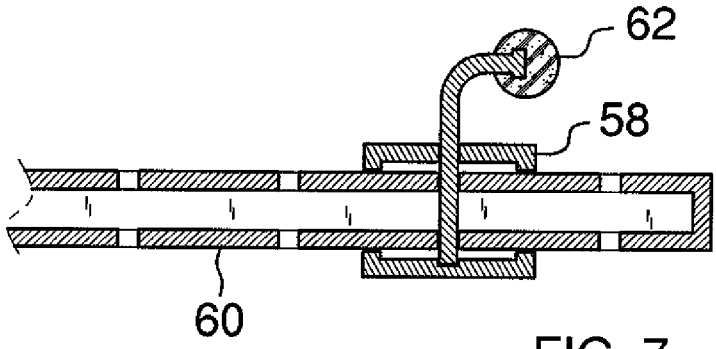
FIG. 7 is a cross-sectional taken along line 7-7 of FIG. 2 view of the present invention.

With reference now to the drawings, and in particular to FIGS. 1 through 9 thereof, a new exercising device embodying the principles and concepts of the present invention and generally designated by the reference numeral 10 will be described.

As best illustrated in FIGS. 1 through 9, the abdominal exercising apparatus 10 generally comprises a frame 12 that includes a first lateral member 14, a second lateral member 16, a first end member 18 and a second end member 20 attached together in a rectangular configuration. The first 14 and second 16 lateral members are orientated parallel to each other and perpendicular to the first 18 and second 20 end members. The frame 12 has an upper surface 22 and a lower surface 24. A lower surface of the first end member 18 may be open for reasons explained below. The first 14 and second 16 lateral members each have a length between 4 feet and 7 feet and are spaced from each other a distance between 6 inches and 24 inches. A plurality of legs 26 is attached to and extends downwardly from the frame 12. The legs 26 extend downwardly from the frame 12 a distance between 3 inches and 12 inches. The legs 26 may also extend laterally away from the end first 14 and second 16 lateral members to further stabilize the frame 12.

Figure 8:
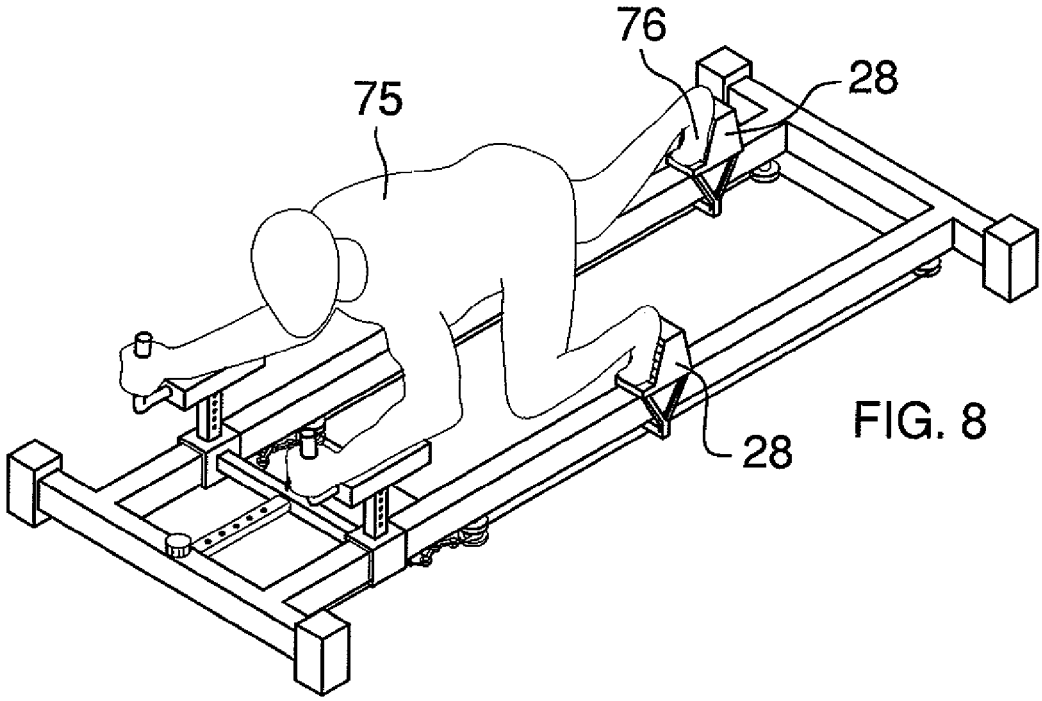
FIG. 8 is an in-use top perspective view of the present invention.
Figure 9:
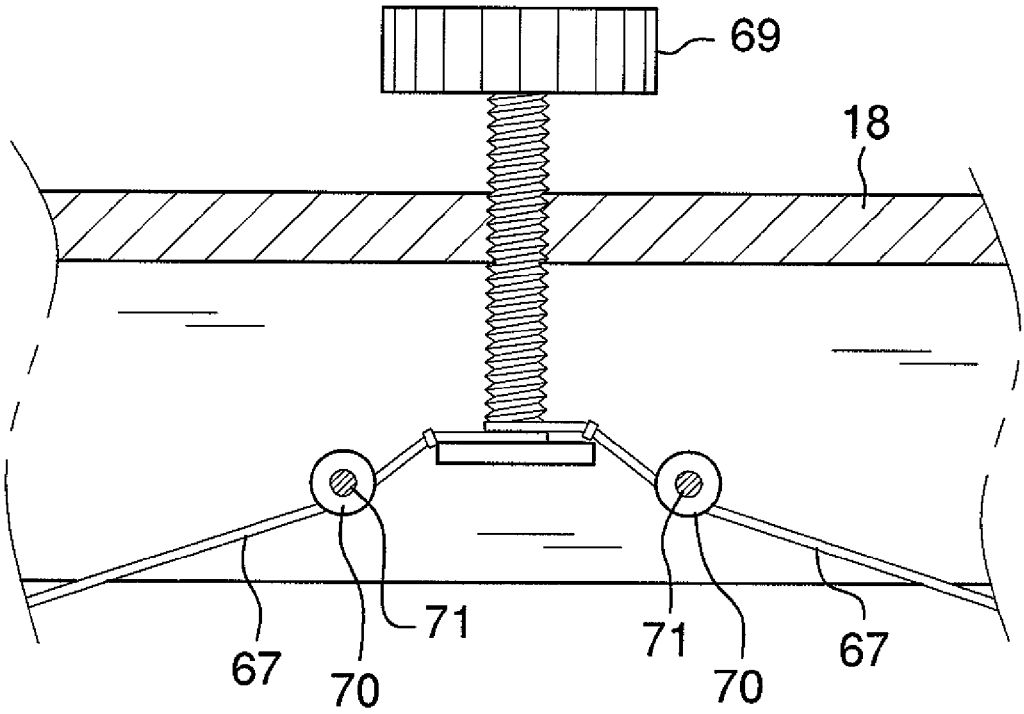
FIG. 9 is a cross-sectional view taken along line 9-9 of FIG. 2 of the present invention.

A pair of slides 28 is provided. Each of the first 14 and second 16 lateral members has one of the slides 28 attached thereto. The slides 28 are positioned on the upper surface 24 of the frame 12 and coupled thereto by brackets 30. Each of the slides 28 is slidable toward or away from the second end members 20. Each of the slides 28 is engageable with a foot 76 of a person 75. The slides 28 each have a forward face 32 facing toward the first end member 18 that is angled rearward from the upper surface 22 of the frame 12 and toward the second end member 20. The forward faces 32 may include treading to improve gripping with a person's foot 76. Each of the slides 28 includes a flange 33 attached to the forward face 32 that is positioned adjacent to the upper surface 22 of the frame 12. The flanges 34 of the slides 28 receive the toe portion of the person's foot 76 as is shown in FIG. 8.

A connecting assembly 34 is coupled to each of the slides 28. The connecting assembly 34 couples together the slides 28 to cause a first one of the slides to move away from the second end member 20 when a second one of the slides is moved toward the second end member 20. The connecting assembly 34 includes a first pulley 36 attached to the first lateral member 14 and positioned adjacent to the second end member 20. A second pulley 38 is attached to the first lateral member 14 and is positioned between the first pulley 34 and the first end member 18. A third pulley 40 is attached to the second lateral member 16 and is positioned adjacent to the second end member 20. A fourth pulley 42 is attached to the second lateral member 16 and is positioned between the third pulley 40 and the first end member 18. A tether 44 is wound around the first 36, second 38, third 40 and fourth 42 pulleys so that the tether 44 can rotate around the first through fourth pulleys. Each of the slides 28 is attached to the tether 44, such as by the brackets 30, which causes the slides 28 to move oppositely with respect to the second end member 20.

A pair of arm supports 46 is provided. Each of the first 14 and second 16 lateral members has one of the arm supports 46 attached thereto. Each of the arm supports 46 is selectively positionable nearer to or away from the first end member 18. The arm supports 46 each include a post 48 that has a bottom end 50 and a top end 52. The bottom end 50 is attached to an associated on of the first 14 and second 16 lateral members.

The bottom ends 50 may form sleeves receiving the first 14 or second 16 lateral members. The post 48 is telescopic and has an adjustable height. A cushioning member 54 is attached to the top end 52. A grip 56 is attached to the post 48 and extends outwardly from the cushioning member 54 and toward the first end member 18. A rod 58 is attached to and extends between the bottom ends 50. The rod 58 is selectively attached to a support bar 60 being attached to the first end member 18 and extending toward the second end member 20. The support bar 60, once secured to the rod 58 such as by a pin 62, secures the arm supports 46 in a selected position relative to the frame 12.

A tension assembly 64 is mounted on the frame 12 and engages the connecting assembly 34 to selectively tighten or loosen movement of the slides 28 with respect to the frame 12. An embodiment of the tension assembly 64 may include straps 66 attached to the second 38 and fourth 42 pulleys and scissor clamps 68 attached to the straps 66. A pair of brake lines 67 is provided and each of the brake lines 67 is attached to one of the scissor clamps 68. When the brake lines 67 are tightened by pulling on the brake lines 67, the scissor clamps 68 close which causes the straps 66 to tighten on the second 38 and forth 42 pulleys to restrict their movement to require increased force application to the slides 28 to move the slides 28 with respect to the frame 12. A tightening knob 69 is threadably mounted to the frame 12 and is coupled to each of the brake lines 67 to selectively tighten or loosen the brake lines 67. The brake lines 67 extend around secondary pulleys 70 mounted on spindles 71 attached to the first end member 18 and accessible due to the lower surface 24 thereof being open.

In use, a person 75 selects the tension required with the tension assembly 64 and places the arm supports 46 where desired. The person 75 then places their feet 76 on the slides 28 while facing the frame 12 and rests their forearms on the arm supports 46 as shown in FIG. 8. The person 75 may also grip the grips 56 with their hands to provide stability for the person 75. The person 75 then moves the slides 28 back and forth with their feet to exercise the abdominal muscles while at the same time also receiving an aerobic work out.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An abdominal exercising apparatus comprising:

a frame including a first lateral member, a second lateral member, a first end member and a second end member attached together in a rectangular configuration, said first and second lateral members being orientated parallel to each other and perpendicular to said end members, said frame having an upper surface and a lower surface;

a plurality of legs being attached to and extending downwardly from said frame;

a pair of slides, each of said first and second lateral members having one of said slides attached thereto and being positioned on said upper surface of said frame, each of said slides being slidable toward or away from said second end members, each of said slides being engageable with a person's foot;

a connecting assembly being coupled to each of said slides, said connecting assembly coupling together said slides to cause a first one of said slides to move away from said second end member when a second one of said slides is moved toward said second end member;

a pair of arm supports, each of said first and second lateral members having one of said arm supports attached thereto within the rectangular configuration of the frame, each of the arm supports including:

a post having a bottom end and a top end, said bottom end being attached to an associated one of said first and second lateral members, said post being telescopic and having an adjustable height, an orientation of said post being fixed with respect to the associated one of said first and second lateral members;

a cushioning member being attached to said top end;

a grip being attached to said post, said grip extending outwardly from said cushioning member and toward said first end member; and wherein a person's feet are positionable on said slides while the person faces said upper surface of said frame and said slides are slidable back and forth to exercise the person's abdominal muscles.

2. The apparatus according to claim 1, wherein said first and second lateral members each have a length between 4 feet and 7 feet, said first and second lateral members being spaced from each other a distance between 6 inches and 24 inches.

3. The apparatus according to claim 1, wherein each of said slides has a forward face facing toward said first end member, said forward faces of said slides being angled rearward from said upper surface of said frame and toward said second end member.

4. The apparatus according to claim 2, wherein each of said slides includes a flange attached to said forward face and being positioned adjacent to said upper surface of said frame.

5. The apparatus according to claim 1, wherein said connecting assembly includes:

a first pulley being attached to said first lateral member and being positioned adjacent to said second end member;

a second pulley being attached to said first lateral member and being positioned between said first pulley and said first end member;

a third pulley being attached to said second lateral member and being positioned adjacent to said second end member;

a fourth pulley being attached to said second lateral member and being positioned between said third pulley and said first end member;

a tether being wound around said first, second, third and fourth pulleys, each of said slides being attached to said tether.

6. The apparatus according to claim 1, wherein each of said arm supports is selectively positionable nearer to or away from said first end member.

7. The apparatus according to claim 6, further including a tension assembly being mounted on said frame and engaging said connecting assembly to selectively tighten or loosen movement of said slides with respect to said frame.

8. The apparatus according to claim 1, further including a tension assembly being mounted on said frame and engaging said connecting assembly to selectively tighten or loosen movement of said slides with respect to said frame.

9. An abdominal exercising apparatus comprising:

a frame including a first lateral member, a second lateral member, a first end member and a second end member attached together in a rectangular configuration, said first and second lateral members being orientated parallel to each other and perpendicular to said end members, said frame having an upper surface and a lower surface, said first and second lateral members each having a length between 4 feet and 7 feet, said first and second lateral members being spaced from each other a distance between 6 inches and 24 inches;

a plurality of legs being attached to and extending downwardly from said frame, said legs extending downwardly from said frame a distance between 3 inches and 12 inches;

a pair of slides, each of said first and second lateral members having one of said slides attached thereto and being positioned on said upper surface of said frame, each of said slides being slidable toward or away from said second end members, each of said slides being engageable with a person's foot, each of said slides having a forward face facing toward said first end member, said forward faces of said slides being angled rearward from said upper surface of said frame and toward said second end member, each of said slides including a flange attached to said forward face and being positioned adjacent to said upper surface of said frame;

a connecting assembly being coupled to each of said slides, said connecting assembly coupling together said slides to cause a first one of said slides to move away from said second end member when a second one of said slides is moved toward said second end member, said connecting assembly including;

a first pulley being attached to said first lateral member and being positioned adjacent to said second end member;

a second pulley being attached to said first lateral member and being positioned between said first pulley and said first end member;

a third pulley being attached to said second lateral member and being positioned adjacent to said second end member;

a fourth pulley being attached to said second lateral member and being positioned between said third pulley and said first end member;

a tether being wound around said first, second, third and fourth pulleys, each of said slides being attached to said tether;

a pair of arm supports, each of said first and second lateral members having one of said arm supports attached thereto, each of said arm supports being selectively positionable nearer to or away from said first end member, each of said arm supports including;

a post having a bottom end and a top end, said bottom end being attached to an associated on of said first and second lateral members, said post being telescopic and having an adjustable height, an orientation of said post being fixed with respect to the associated one of said first and second lateral members;

a cushioning member being attached to said top end;

a grip being attached to said post, said grip extending outwardly from said cushioning member and toward said first end member;

a tension assembly being mounted on said frame and engaging said connecting assembly to selectively tighten or loosen movement of said slides with respect to said frame; and wherein a person's feet are positionable on said slides while the person faces said upper surface of said frame and said slides are slidable back and forth to exercise the person's abdominal muscles.

* * * * *